US009636561B2

(12) United States Patent
Simon

(10) Patent No.: US 9,636,561 B2
(45) Date of Patent: May 2, 2017

(54) HOCKEY PUCK REBOUNDING DEVICE

(71) Applicant: Thomas Chapman Simon, Manchester, NH (US)

(72) Inventor: Thomas Chapman Simon, Manchester, NH (US)

( * ) Notice: Subject to any disclaimer, the term of this patent is extended or adjusted under 35 U.S.C. 154(b) by 0 days.

(21) Appl. No.: 14/688,670

(22) Filed: Apr. 16, 2015

(65) Prior Publication Data

US 2015/0297967 A1 Oct. 22, 2015

Related U.S. Application Data

(60) Provisional application No. 61/980,463, filed on Apr. 16, 2014.

(51) Int. Cl.
*A63B 69/00* (2006.01)

(52) U.S. Cl.
CPC ..... *A63B 69/0026* (2013.01); *A63B 2209/10* (2013.01); *A63B 2210/50* (2013.01)

(58) Field of Classification Search
CPC ..... A63B 69/0026
See application file for complete search history.

(56) References Cited

U.S. PATENT DOCUMENTS

| | | | | |
|---|---|---|---|---|
| 5,351,960 | A * | 10/1994 | Knapp | A63B 57/405 473/182 |
| 6,364,790 | B1 * | 4/2002 | Carrie | A63B 69/00 473/278 |
| 8,469,841 | B1 * | 6/2013 | Giauque | A63B 69/0026 473/164 |
| 2009/0042659 | A1 * | 2/2009 | Breaker | A63B 43/002 473/194 |
| 2009/0215548 | A1 * | 8/2009 | Broering | A63B 69/3614 473/220 |
| 2014/0256476 | A1 * | 9/2014 | Sallinen | A63B 69/0026 473/446 |

OTHER PUBLICATIONS http://lerendzonderschool.blogspot.com/2011_02_01_archive.html; Feb. 24, 2011; Julie.*

* cited by examiner

*Primary Examiner* — Gene Kim
*Assistant Examiner* — Jeffrey Vanderveen
(74) *Attorney, Agent, or Firm* — Lambert & Associates; Gary E. Lambert; David J. Connaughton, Jr.

(57) ABSTRACT

A hockey training device is provided. The training device includes a substantially flat sheet with a smooth upper surface. The present invention includes a plurality of elastic band suspended to the upper surface. A first vertical post and a second vertical post may be attached to the flat sheet so that the elastic band is secured about the first and second vertical posts. The elastic band includes a front surface facing towards a center portion of the flat sheet. Therefore, a puck may be passed towards the elastic band and the elastic band rebounds the puck towards the user.

20 Claims, 5 Drawing Sheets

HOCKEY PUCK REBOUNDING DEVICE

CROSS-REFERENCE TO RELATED APPLICATION

This application claims the benefit of priority of U.S. provisional application No. 61/980,463, filed Apr. 16, 2014, the contents of which are herein incorporated by reference.

BACKGROUND OF THE INVENTION

The present invention relates to ice hockey and, more particularly, to an ice hockey trainer.

Ice hockey is a contact team sport played on ice, usually in a rink, in which two teams of skaters use their sticks to shoot a puck into their opponent's net to score goals. Hockey training typically occurs in an ice rink. Ice time is expensive and is not always accessible. Stick handling, shooting and passing the puck are essential skills to improve performance while playing ice hockey.

As can be seen, there is a need for an off the ice training device to improve puck handling skills of a hockey player.

SUMMARY OF THE INVENTION

In one aspect of the present invention, a hockey training device comprises: a first flat sheet comprising a smooth upper surface; and a plurality of elastic bands suspended to the upper surface and each comprising a front surface substantially perpendicular to the flat sheet, wherein the front surface of each of the plurality of elastic bands is facing towards a center portion of the flat sheet.

In another aspect of the present invention, a hockey training device comprises: a first flat sheet and a second flat sheet each comprising a smooth upper surface, wherein the first flat sheet and the second flat sheet are connected together by a hinge; and at least one elastic band suspended to the upper surface of the first flat sheet and comprising a front surface substantially perpendicular to the first flat sheet, wherein the front surface of the at least one elastic band is facing towards a center portion of the hockey training device.

These and other features, aspects and advantages of the present invention will become better understood with reference to the following drawings, description and claims.

DETAILED DESCRIPTION OF THE INVENTION

Figure 1:
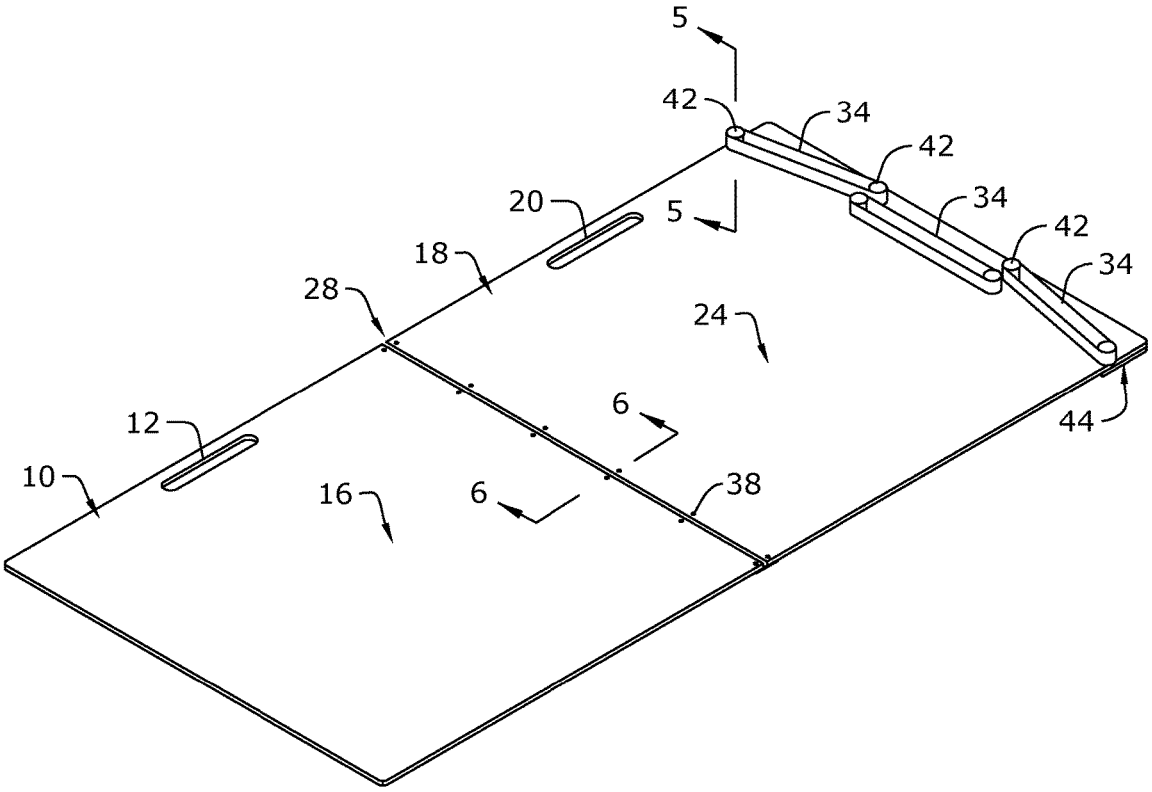
FIG. 1 is a top perspective view of an embodiment of the present invention.
Figure 2:
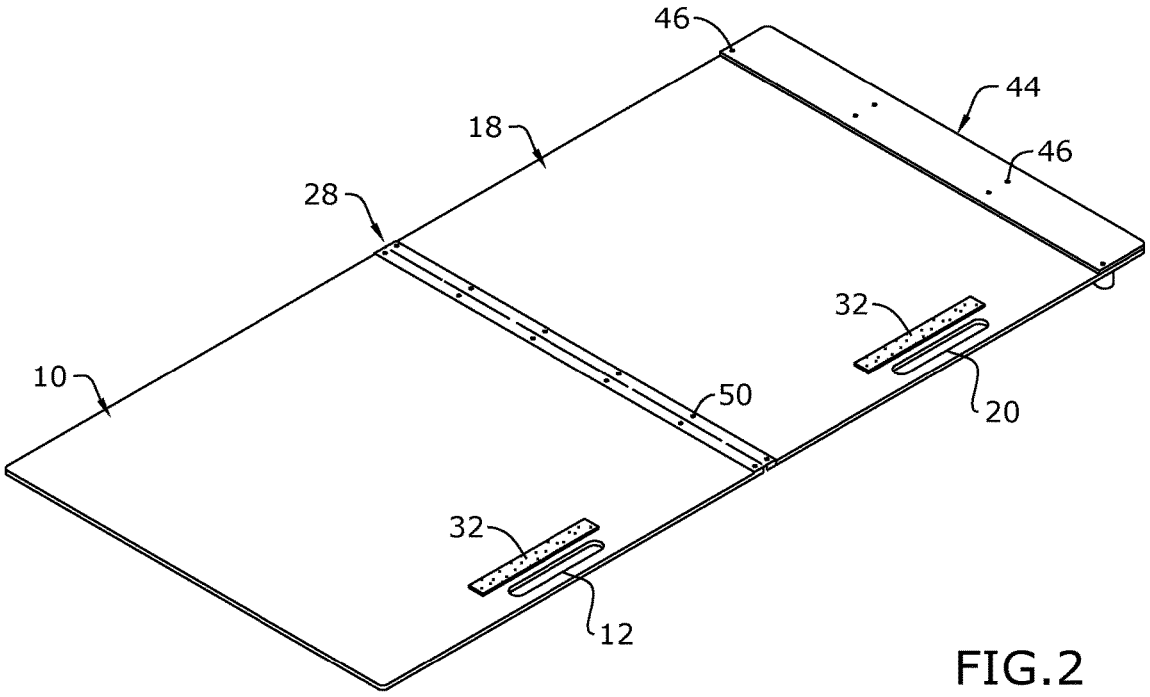
FIG. 2 is a bottom perspective view of an embodiment of the present invention.
Figure 3:
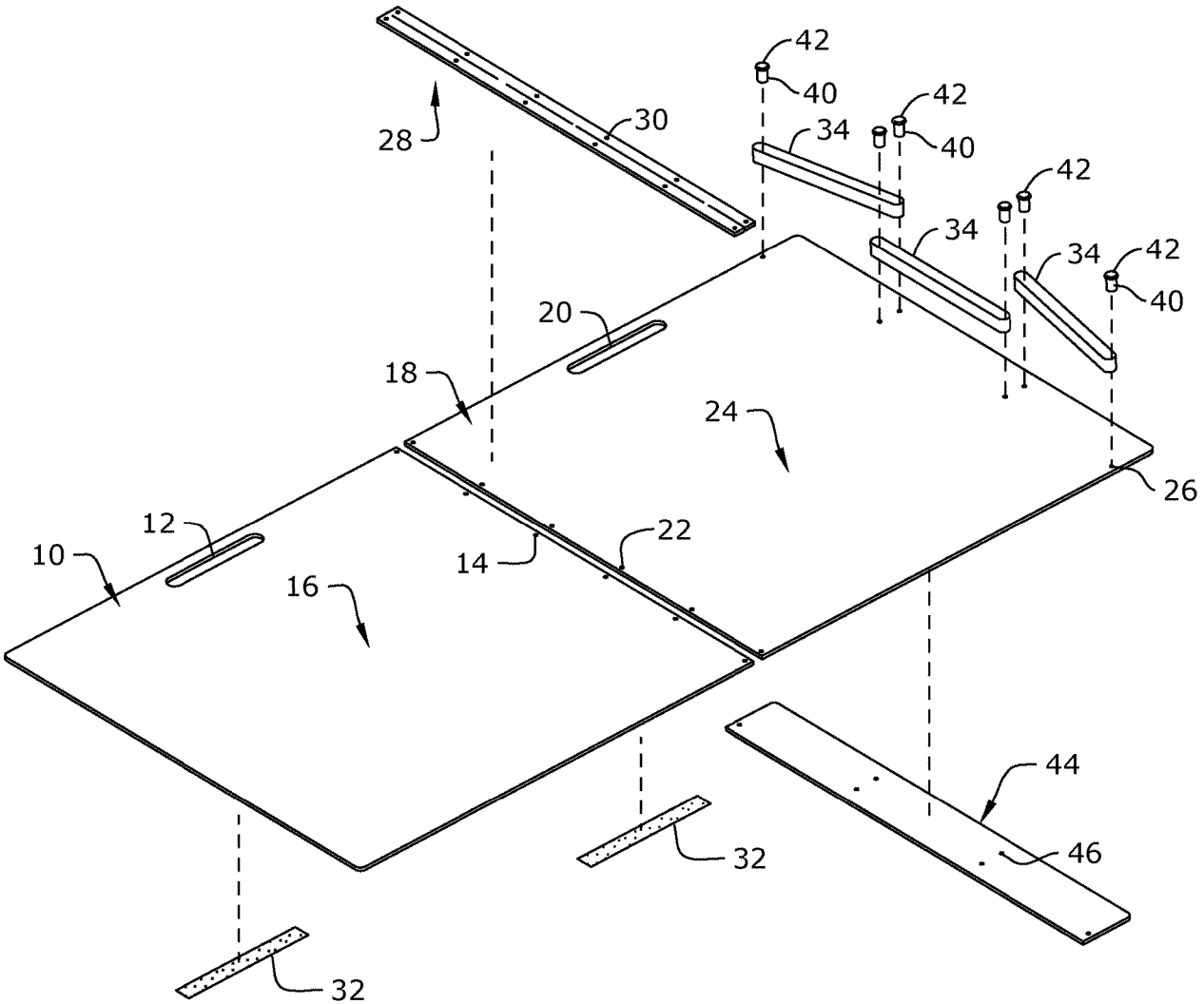
FIG. 3 is an exploded view of an embodiment of the present invention.
Figure 4:
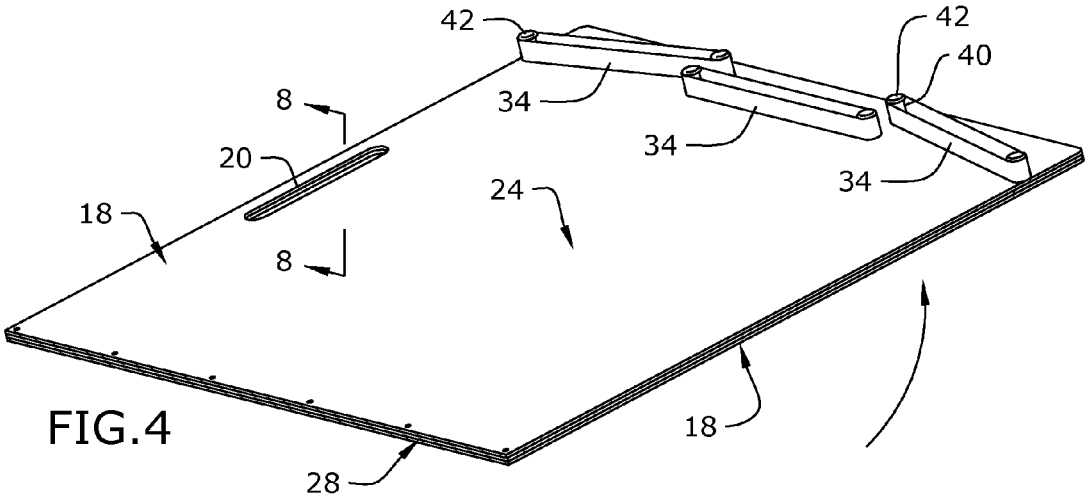
FIG. 4 is a perspective view of an embodiment of the present invention in a folded state.
Figure 5:
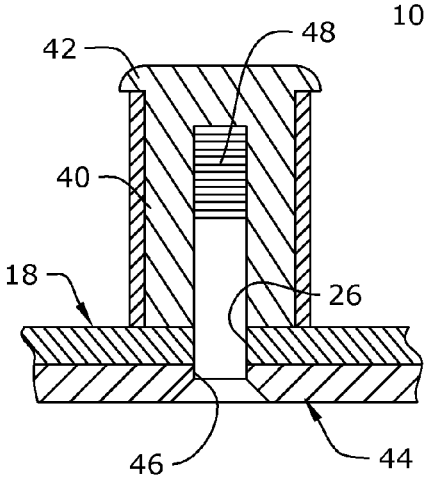
FIG. 5 is a section detail view of the present invention along line 5-5 in FIG. 1.
Figure 6:
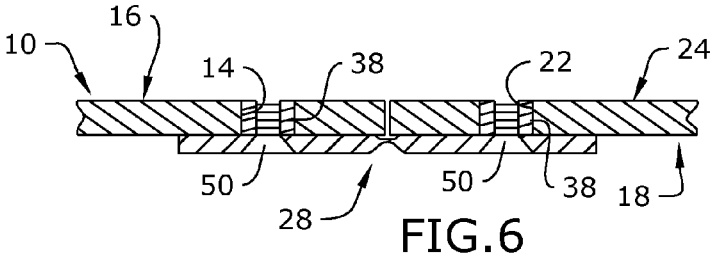
FIG. 6 is a section detail view of the present invention along line 6-6 in FIG. 1.
Figure 7:
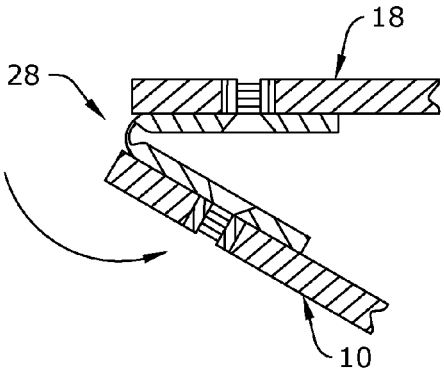
FIG. 7 is a section detail view of the present invention demonstrating a live hinge in operation.
Figure 8:
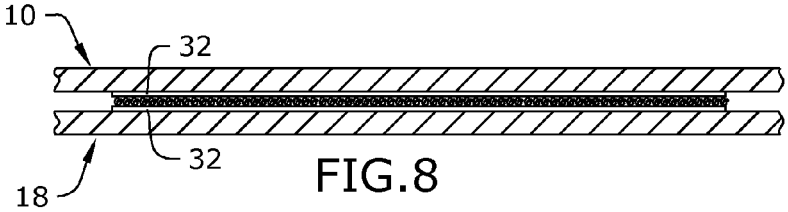
FIG. 8 is a section detail view along line 8-8 in FIG. 4.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an ice hockey training aid used to promote and develop essential hockey puck skills such as shooting, passing, and stick handling. The present invention eliminates the need for costly ice time to practice individual puck skills. The present invention can be used all year round inside or outside increasing the player's practice time to develop essential skills.

The present invention includes a uniquely designed system integrated with three angled rebounding bands that enhances real hockey situations. Engineered utilizing advanced fabricated plastic polymers improves smooth puck sliding performance with a secure and tight mechanism increasing rebounding performance.

Referring to FIGS. 1 through 12, the present invention includes a hockey training device. The training device includes a substantially flat first sheet 18 with a smooth upper surface 24. The present invention includes at least one elastic band 34 suspended to the upper surface. A first vertical post 40 and a second vertical post 40 may be attached to the first flat sheet 18 so that the elastic band 34 is secured about the first and second vertical posts 40. The elastic band 34 includes a front surface facing towards a center portion of the first flat sheet 18. Therefore, a puck may be passed towards the elastic band 34 and the elastic band 34 rebounds the puck towards the user.

In certain embodiments, the present invention may include a plurality of bands 34 oriented at different angles in order to rebound the puck back to the center portion of the first flat sheet 18. For example, the present invention may include a first elastic band 34 suspended in between a second elastic band 34 and a third elastic band 34. A front surface of the second elastic band 34 and the third elastic band 34 are suspended at an angle relative to the front surface of the first elastic band 34 so that the front surfaces of each of the elastic bands 34 are facing towards the center portion of the flat sheet 18. Therefore, the user may shoot to the middle, to the left or to the right, and the puck may rebound to the same center portion of the flat sheet 18.

The vertical posts 40 of the present invention may be mounted to the flat sheet 18 via apertures 26, 46 and fasteners 48. In certain embodiments, the present invention may include a backer plate 44 including a plurality of apertures 46. The flat sheet 18 includes apertures 26 that align with the apertures 46 of the backer plate 44. The fasteners 48 may run through the aligned apertures 26, 46 and into the vertical posts 40, thereby connecting the backer plate 44 to a lower surface of the first flat sheet 18 and the vertical posts 40 to the upper surface of the first flat sheet 18. In certain embodiments, the vertical posts 40 may include post flanges 42 extending radially from the post 40 to prevent the bands 34 from slipping off the posts 40.

In certain embodiments, the present invention may include a second flat sheet 10 with a smooth upper surface 16 substantially the same as the first flat sheet 18. The second flat sheet 10 may be connected to the first flat sheet 18 by a hinge 28, and may thereby fold relative to one another into a folded position. In certain embodiments, the first flat sheet 18 and the second flat sheet 10 may each include cutout portions along an edge, forming handles 12 and 20. A connector may releasably connect the first flat sheet 18 and the second flat sheet 10 in a folded position. The connector may include a hook and loop fastener 32 attached to the lower surfaces of the first flat sheet 18 and the second flat sheet 10. Therefore, the first flat sheet 18 and the second flat sheet 10 may be folded about the hinge 28 and the lower surfaces may be attached to one another. The handles 12 and 20 may align, and a user may easily transport the folded hockey training device.

The hinge 28 of the present invention may connect adjacent edges of the first flat sheet 18 and the second flat sheet 10. The hinge 28 may be a polymer hinge 28. In certain embodiments, the hinge 28 may include a first thick panel attached to the first flat sheet 18, a second thick panel attached to the second flat sheet 10, and a thin portion connecting the first thick panel and the second thick panel. The first flat sheet 18 may include apertures 22 that align with apertures 30 on the first thick panel, and the second sheet 10 may include apertures 14 that align with apertures 30 on the second thick panel. Brass threaded inserts 38 may be within apertures 14 and 22. Fasteners 50 may run through the aligning apertures 30 and inserts 38, thereby connecting the hinge 28 to the first flat sheet 18 and the second flat sheet 10. The hinge 28 may fold about the thin portion, thereby folding the first flat sheet 18 and the second flat sheet 10 together.

In certain embodiments, the first flat sheet 18 and the second flat sheet 10 of the present invention may be made of natural white high density polyethelene plastic sheeting. The plastic sheeting provides a smooth upper surface so that the puck may easily glide similar to gliding on ice. The dimensions of the plastic sheeting may also vary. For example, the plastic sheeting may be, but is not limited to, about 40"×60", 40"×80" or other suitable dimensions. The thicknesses may include, but are not limited to, 0.187", 0.125" or the like. The elastic bands 34 may be rubber bands, such as ethylene propylene diene monomer (EPDM) that may be about 1.125 includes wide, about 0.063 inches thick, and having about an eight inch flat front surface. The elastic bands 34 may be UV resistant. The vertical posts may be made of acetyl plastic.

Figure 9:
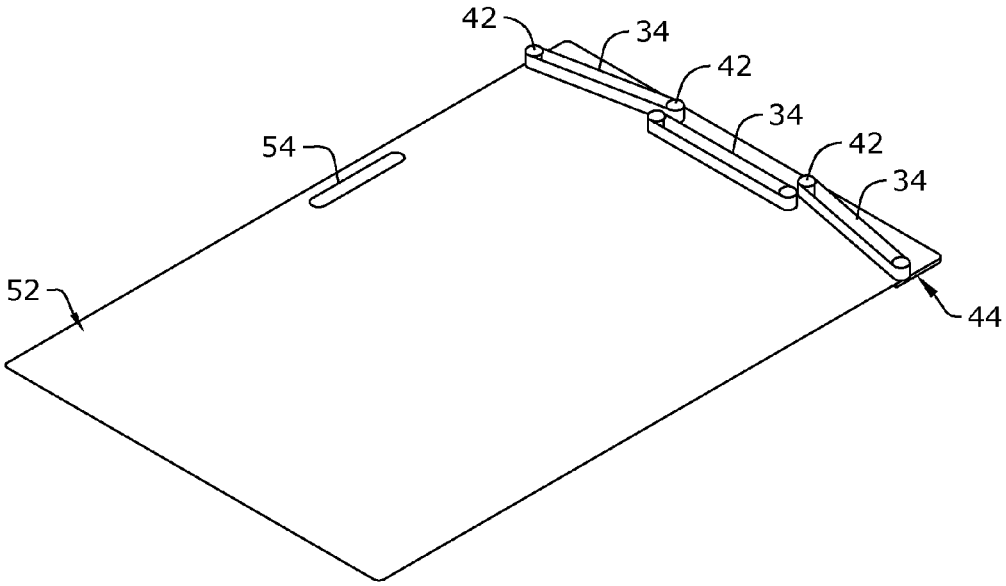
FIG. 9 is a perspective view of an embodiment of the present invention.
Figure 10:
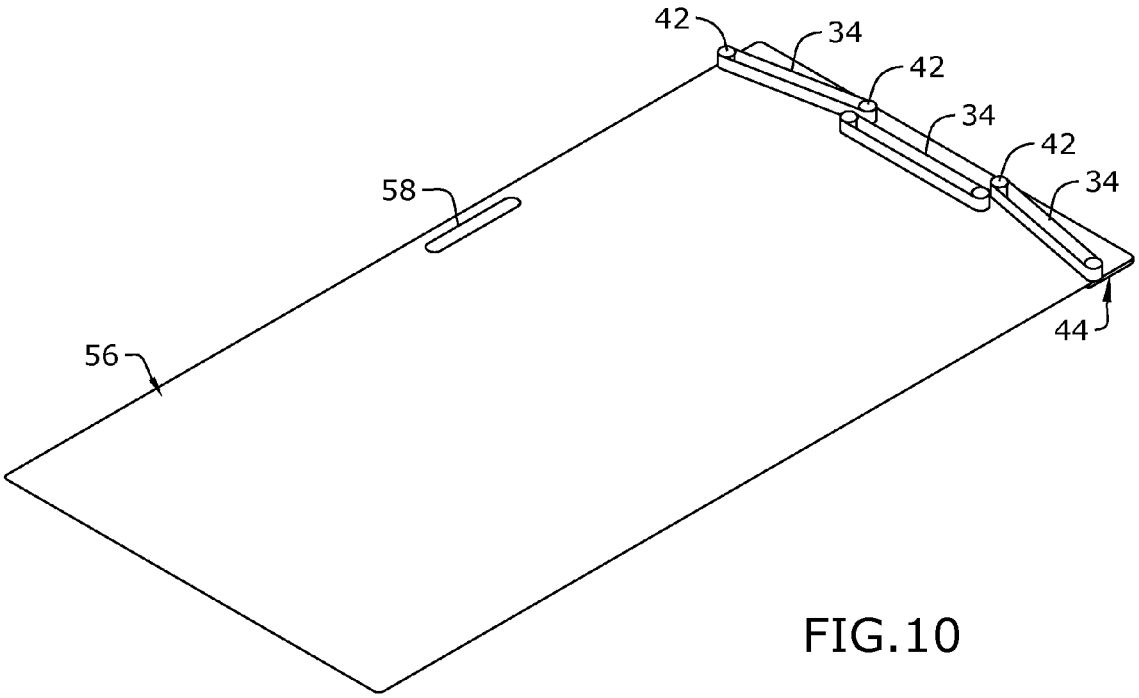
FIG. 10 is a perspective view of an embodiment of the present invention.
Figure 11:
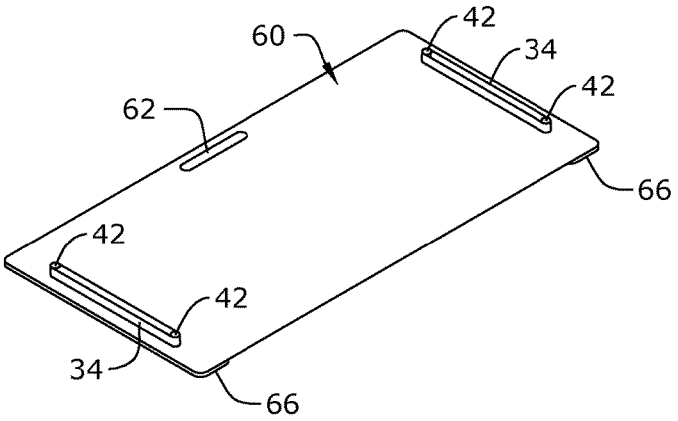
FIG. 11 is a perspective view of an embodiment of the present invention.
Figure 12:
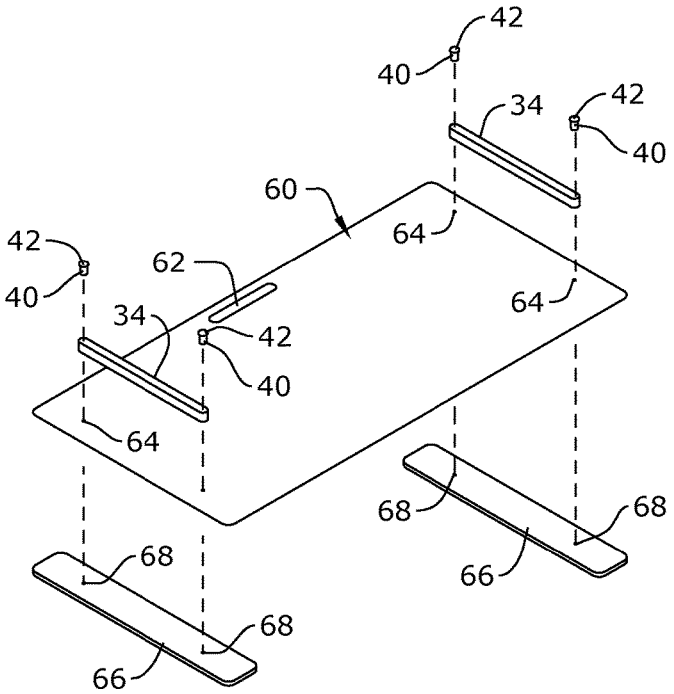
FIG. 12 is a perspective view of an embodiment of the present invention.

As illustrated in the Figures, the present invention may come in multiple shapes and sizes. As illustrated in FIG. 9, the flat sheet 52 may include a shorter length, and may not be hingedly connected to another sheet. The flat sheet 52 may include a cutout portion 54 for the handle. FIG. 10 may include a flat sheet 56 with a longer length, which is also not hingedly connected to another sheet. The flat sheet 56 may include a cutout portion 58 for the handle. The seamless flat sheets 52, 56 may include, but are not limited to, the following dimensions, about 40"×60" and about 40"×80". As illustrated in FIGS. 11 and 12, the present invention may include a band 34 suspended on opposing sides of the sheet 60. Each side may include a backer plate 66 that has apertures 68 that align with apertures 64 formed through the sheet 60. Thereby, the backers 66 may be suspended to the sheet 60 through the aligning apertures 64, 68 via fasteners. In certain embodiments, the sheet 60 may include, but is not limited to, the following dimensions, 30"×60" single band and 30"×60" double band rebounder.

As stated above, Ice Hockey players have little individual time to develop essential hockey puck skills such as stick handling, passing, and shooting. Regular practices focus on team play rather than individual skill enhancement. The present invention claimed here solves this problem.

This training aid eliminates the need for costly ice time to practice individual puck skills. This aid can be used year round inside or outside increasing the player's practice time to develop essential skills.

The claimed invention differs from what currently exists. Prior to this device, there are no other ice hockey plastic puck skills training aid that fold conveniently in half. This feature makes portability easy, saves on storage space, and reduces shipping costs.

This aid comes fully assembled and ready to use. Other devices require various assembly options and sourcing of required parts causing inconsistencies and poor performance. Needed adjustments are required to maintain performance.

Uniquely designed system, integrated with three separate angled rebounding bands incorporated in the (Puck Sliding Surface) enhances real hockey situations. Advanced plastic polymers improve smooth puck sliding performance with secure tight mechanism increasing rebounding power.

The Version of the Invention Discussed Here Includes:

1. Puck Sliding Surface A—Natural High Density Polyethylene Plastic sheet 3/16" thick×40"×40". 6 Drilled holes 3/16" in diameter in a particular pattern to match up with the same pattern as a Backer Plate for attaching rebounding system. 6 drilled holes 0.261 "diameter used to attach poly hinge. Router hole for handle 1"×4½" matches up exactly to routed hole on Puck Sliding Surface B when board is folded making a handle.
2. Puck Sliding Surface B—Natural High Density Polyethylene plastic sheet 3/16" thick×40"×40"×3/16" thick. 6 drilled holes diameter 0.0261". Drilled holes are for attaching poly hinge.
3. Backer Plate—Lexan polycarbonate plastic ¼" thick×4¾"×40". 6 drilled and counter sunk holes for attaching rebounder system. All 4 corners 1" radius. 4.
4. Post—6 Natural acetyl plastic commonly called Delrin. 1"×1⅛" length. Drilled and tapped on bottom side 10/32" thread.
5. Band—EPDM Ethylene Propylene Diene Monomer, 8" flat length×1¼" wide×0.063" wall.
6. Insert—Brass Press-Fit Insert. 10-32 inch internal Thread, 3/16".
7. Backer Screw—Machine Flat Head Screw 10-32" thread×1" length.
8. Poly Hinge—Black Polypropylene UV resistant 1½" wide×40" long×1/10" thick.
9. Fasteners Strips—Velcro strips ¾"×3".
10. Hinge Screw—Machine Flat Head 10/32" thread×¼" length.

Relationship Between the Components:

The puck sliding surface A and B connect together to make up the total surface of the Puck Sliding Surface which folds and unfolds. They are connected on the back side utilizing the Insert, and the hinge screw, and the Poly Hinge. The Backer Plate attaches to back side of puck sliding surface A using backer screws and posts. The band stretches around 2 posts in 3 separate locations creating 3 separate angled rebounding bands. The Fastener Strips place in same mirror image on back of puck sliding surface A and B meeting together holding the board folded in place until ready for use.

How the Invention Works:

With the use of a High Density Polyethylene Plastic sheet which has a low coefficient of friction and an EPDM elastic band. The puck is passed into the rebounding bands which makes the puck slide freely back to the player. This action simulates real hockey situations without using real ice. The Puck Sliding Surface protects expensive hockey stick from rough surfaces such as a driveway.

How to Make the Invention:

1. Using 3/16" thick Natural HDPE (High Density Polyethylene) each Plastic sheet puck sliding surface A and B is cut to size 40"×40".
2. 6 drilled thru holes with diameter of 0.261" in each puck sliding surface A and B. The pattern and position of the holes are in the same place on both parts. Brass Inserts are press fitted in the 12 holes 6 on each side.
3. Poly Hinge is cut to length 40". 12 drilled countered sunk holes 6 on each side of hinge. Using the Hinge Screw to connect Poly Hinge to back side of puck sliding surface A and B connecting both parts together.
4. Puck sliding surface A Has additional 6 drilled thru holes diameter 0.261" used to attached the Backer Plate which has the same hole pattern.
5. The Backer Plate, Lexan (Polycarbonate) Plastic sheet ¼" thick cut to size 40"×4.75". 6 counter sunk drilled thru holes 0.196" diameter. Hole pattern the same as puck sliding surface A. All 4 corners have 1" radius.
6. Acetal Plastic natural 1" diameter rod. (Commonly called Delrin) is CNC machined into post drilled and tapped with 10/32" screw thread.
7. Using the Screws that are used to assemble the backer plate to puck sliding surface A and the Post in a secure tight fashion.
8. Velcro® Strips are applied, pressure sensitive in the same position on both puck sliding surface A and B below the handle hole.

The HDPE natural 3/16" Plastic sheet, Elastic EPDM band and poly hinge are included in the present invention. The routed hole for carrying handle is optional. By adding elastic EPDM bands to both ends of the Training Aid the player could pass in both directions using forehand and back handed stick handling motions. Not able to interchange or reconfigure to achieve same results.

How to Use the Invention:

A hockey player unfolds the training aid and stands next to the device with a hockey stick and puck. The player passes the puck into one of three angled rebounding bands which rebounds the puck freely back to the player keeping the puck in motion, like a puck on ice. The player then practices stick handling moves like a "Toe Drag" and then shoots the puck into a street hockey goal net using different types of shots, such as a slap shot, snap shot, or wrist shot.

The present invention includes an ice hockey training aid used to develop hockey puck skills, such as shooting, passing and stick handling is disclosed. The present invention is uniquely designed device that folds in half. A rebounding system is integrated into the puck sliding surface with three separate angled rebounding bands, which enhances real hockey situations. The present invention is engineered utilizing advanced plastic polymer parts, which improves smooth puck sliding performance with a secure and tight mechanism increasing rebounding power.

It should be understood, of course, that the foregoing relates to exemplary embodiments of the invention and that modifications may be made without departing from the spirit and scope of the invention as set forth in the following claims.

What is claimed is:

1. A hockey training device comprising:

a first flat sheet comprising a smooth upper surface;

a plurality of rubber bands each suspended at a different portion of the upper surface and each comprising a front surface substantially perpendicular to the flat sheet;

wherein the front surface of each of the plurality of rubber bands is disposed at an angle relative to one another and is facing towards a center portion of the flat sheet;

wherein the plurality of rubber bands comprises a first rubber band suspended in between a second rubber band and a third rubber band, the first rubber band positioned adjacent to a lengthwise edge of the flat sheet approximately parallel to the lengthwise edge, the second rubber band positioned to one side of the first rubber band and angled toward the center portion, the third rubber band positioned to a second side of the first rubber band and angled toward the center portion; and wherein the plurality of rubber bands are configured and arranged such that an incoming hockey puck traveling on the upper surface, and upon impact of the incoming hockey puck, the plurality rubber bands causes the hockey puck to rebound towards the center portion;

further comprising a plurality of pairs of vertical posts, wherein each of the plurality of rubber bands is secured to one pair of vertical posts, each of the plurality of rubber bands wrapped around two of the plurality of posts such that two layers of the band material are parallel.

2. The hockey training device of claim 1, wherein a front surface of the second rubber band and the third rubber band are suspended at an angle relative to the front surface of the first rubber band so that the front surfaces are facing towards the center portion of the flat sheet.

3. The hockey training device of claim 1, further comprising a second flat sheet connected to the first flat sheet by a hinge.

4. The hockey training device of claim 3, wherein the hinge is an integral polymer hinge and comprises a first thick panel attached to the first flat sheet, a second thick panel attached to the second flat sheet, and a thin portion connecting the first thick panel and the second thick panel, wherein the hinge folds about the thin portion.

5. The hockey training device of claim 3, further comprising a connector releasably connecting the first flat sheet and the second flat sheet in a folded position.

6. The hockey training device of claim 5, wherein the second flat sheet comprises a cutout portion aligning with the cutout portion of the first flat sheet in the folded position.

7. The hockey training device of claim 1, wherein an end of the front surface of each of the second band and the third band are disposed behind the first band.

8. The hockey training device of claim 1 wherein each of the plurality of rubber bands are configured to rebound the hockey puck without the hockey puck hitting another of the plurality of rubber bands.

9. The hockey training device of claim 1 wherein the plurality of elastic bands are selected to be capable of repeated impact and rebounding of a hockey puck.

10. The hockey training device of claim 1 wherein each of the plurality of elastic bands is secured to only two of the plurality of posts.

11. The hockey training device of claim 10 wherein two of the plurality of posts are adjacent to each other with one directly behind the other, and wherein the first elastic band is attached to a first of the two of the plurality of posts, and wherein the second elastic band is attached to a second of the two of the plurality of posts, thereby causing the first and second elastic bands to overlap slightly, the second and third rubber band having a portion that is behind the first rubber band.

12. A hockey training device comprising:

a first flat sheet and a second flat sheet each comprising a smooth upper surface;

a plurality of elastic bands suspended to the upper surface of the first flat sheet and each of the plurality of elastic bands comprising a front surface substantially perpendicular to the first flat sheet;

a polymer hinge connecting the first flat sheet and the second flat sheet together, wherein the polymer hinge comprises a first thick panel attached to the first flat sheet, a second thick panel attached to the second flat sheet, and a thin portion connecting the first thick panel and the second thick panel, wherein the first thick panel, the thin portion, and the second thick panel are integral, and wherein the hinge folds about the thin portion, wherein the front surface of the plurality of elastic bands is facing towards a center portion of the hockey training device;

a first of the plurality of rubber bands positioned adjacent to a lengthwise edge of the flat sheet approximately parallel to the lengthwise edge, a second of the plurality of rubber bands positioned to one side of the first rubber band and angled toward the center portion, a third of the plurality of rubber bands positioned to a second side of the first rubber band and angled toward the center portion; and wherein the plurality of rubber bands are configured and arranged such that an incoming hockey puck traveling on the upper surface, and upon impact of the incoming hockey puck, the plurality rubber bands causes the hockey puck to rebound towards the center portion;

further comprising a plurality of pairs of vertical posts, wherein each of the plurality of rubber bands is secured to one pair of vertical posts, each of the plurality of rubber bands wrapped around two of the plurality of posts such that two layers of the band material are parallel.

13. The hockey training device of claim 12, wherein the at least one band comprises a first elastic band suspended in between a second elastic band and a third elastic band.

14. The hockey training device of claim 13, wherein a front surface of the second elastic band and the third elastic band are suspended at an angle relative to the front surface of the first elastic band so that the front surfaces are facing towards the center portion of the first flat sheet.

15. The hockey training device of claim 12, further comprising a pair of vertical posts, wherein the at least one elastic band is secured to the pair of vertical posts.

16. The hockey training device of claim 12, further comprising a connector releasably connecting the first flat sheet and the second flat sheet in a folded position.

17. The hockey training device of claim 12, wherein the connector is a hook and loop fastener attached to a lower surface of the first flat sheet and the second flat sheet.

18. The hockey training device of claim 16, wherein the connector is a hook and loop fastener attached to a lower surface of the first flat sheet and the second flat sheet.

19. The hockey training device of claim 12, further comprising a backer plate attached to the lower surface of first flat sheet, wherein the back plate comprises a highly impact resistant polycarbonate plastic.

20. The hockey training device of claim 12, wherein the first flat sheet and the second flat sheet each comprises a cutout portion aligning with one another in the folded position.

* * * * *